US007294441B2

(12) United States Patent
Baker et al.

(10) Patent No.: US 7,294,441 B2
(45) **Date of Patent: *Nov. 13, 2007**

(54) METHOD AND APPARATUS FOR USING A TRANSFER ASSIST LAYER IN A TANDEM ELECTROPHOTOGRAPHIC PROCESS UTILIZING ADHESIVE TONER TRANSFER

(75) Inventors: James A. Baker, Hudson, WI (US); Truman F. Kellie, Lakeland, MN (US); Gay Herman, Cottage Grove, MN (US); Brian P. Teschendorf, Vadnais Heights, MN (US); A. Kristine Fordahl, St. Paul, MN (US)

(73) Assignee: Samsung Electronics Co., Ltd., Suwon (KR)

( * ) Notice: Subject to any disclaimer, the term of this patent is extended or adjusted under 35 U.S.C. 154(b) by 449 days.

This patent is subject to a terminal disclaimer.

(21) Appl. No.: 10/884,702

(22) Filed: Jun. 30, 2004

(65) Prior Publication Data

US 2005/0142471 A1 Jun. 30, 2005

Related U.S. Application Data

(60) Provisional application No. 60/533,716, filed on Dec. 31, 2003.

(51) Int. Cl.
*G03G 15/01* (2006.01)
*G03G 15/16* (2006.01)

(52) U.S. Cl. ..... 430/47; 430/117; 399/251; 399/296

(58) Field of Classification Search ..... 430/47, 430/117; 399/251, 296
See application file for complete search history.

(56) References Cited

U.S. PATENT DOCUMENTS

| | | | |
|---|---|---|---|
| 3,157,546 | A | 11/1964 | Cover |
| 3,411,936 | A | 11/1968 | Roteman et al. |
| 3,716,360 | A | 2/1973 | Fukushima et al. |
| 3,808,026 | A | 4/1974 | Sato et al. |
| 3,893,761 | A | 7/1975 | Buchan et al. |
| 4,337,303 | A | 6/1982 | Sahyun et al. |

(Continued)

FOREIGN PATENT DOCUMENTS

| | | |
|---|---|---|
| EP | 0410800 B1 | 1/1991 |

OTHER PUBLICATIONS

Schmidt, S.P. and Larson, J.R., in Handbook of Imaging Materials Diamond, A.S., Ed: Marcel Dekker: New York; Ch. 6, pp. 227-252.

(Continued)

*Primary Examiner*—Hoa Van Le
(74) *Attorney, Agent, or Firm*—Kagan Binder, PLLC

(57) ABSTRACT

A method of producing a composite image on a final image receptor from image data in a single pass electrophotographic system is provided. The method includes steps for applying liquid transfer assist material comprising charged particles of transfer assist material to at least a portion of an element of the electrophotographic system, along with charged toner particles, in order to provide a composite image layer on a final image receptor in a single pass of a photoreceptive element through transfer of the composite image layer from another element in the system.

27 Claims, 10 Drawing Sheets

U.S. PATENT DOCUMENTS 4,413,048 A 11/1983 Landa
4,420,244 A 12/1983 Landa
5,037,718 A 8/1991 Light et al.
5,176,974 A 1/1993 Till et al.
5,215,852 A 6/1993 Kato et al.
5,370,960 A 12/1994 Cahill et al.
5,383,008 A 1/1995 Sheridon
5,391,445 A 2/1995 Kato et al.
5,395,721 A 3/1995 Kato et al.
5,420,675 A 5/1995 Thompson et al.
5,420,676 A 5/1995 Arcaro
5,432,591 A 7/1995 Geleynse
5,521,271 A 5/1996 Smith et al.
5,582,941 A 12/1996 Kato et al.
5,589,308 A 12/1996 Kato et al.
5,604,070 A 2/1997 Rao et al.
5,620,822 A 4/1997 Kato et al.
5,626,996 A 5/1997 Kato et al.
5,648,190 A * 7/1997 Kato et al. ..... 430/47
5,650,253 A 7/1997 Baker et al.
5,689,785 A 11/1997 Kato et al.
5,733,698 A 3/1998 Lehman et al.
5,744,269 A 4/1998 Bhattacharya et al.
5,747,214 A 5/1998 Kato et al.
5,916,718 A 6/1999 Kellie et al.
5,919,866 A 7/1999 Rao et al.
6,045,956 A 4/2000 Kato et al.
6,255,363 B1 7/2001 Baker et al.
2002/0114637 A1 8/2002 Park et al.
2002/0122948 A1 9/2002 Simpson et al.
2003/0134940 A1 9/2002 Ohkubo et al.
2004/0005510 A1* 1/2004 Asami et al. ..... 430/114
2004/0091808 A1 5/2004 Qian et al.
2004/0091809 A1 5/2004 Qian et al.
2005/0141928 A1* 6/2005 Teschendorf et al. ..... 399/296

OTHER PUBLICATIONS

Film Formation (Z.W. Wicks, Federation of Societies for Coatings Technologies, p. 8 (1986).

* cited by examiner

METHOD AND APPARATUS FOR USING A TRANSFER ASSIST LAYER IN A TANDEM ELECTROPHOTOGRAPHIC PROCESS UTILIZING ADHESIVE TONER TRANSFER

REFERENCE TO RELATED APPLICATIONS

This application claims the benefit of U.S. Provisional application Ser. No. 60/533,716, filed Dec. 31, 2003, entitled "METHOD AND APPARATUS FOR USING A TRANSFER ASSIST LAYER IN A TANDEM ELECTROPHOTOGRAPHIC PROCESS UTILIZING ELASTOMERIC TONER TRANSFER," which application is incorporated herein by reference in its entirety.

Each of the following copending U.S. patent applications of the present Assignee are incorporated herein by reference in its respective entirety:

U.S. Ser. No. 10/884,687, filed on even date herewith, entitled "METHOD AND APPARATUS FOR USING A TRANSFER ASSIST LAYER IN A MULTI-PASS ELECTROPHOTOGRAPHIC PROCESS WITH ELECTROSTATICALLY ASSISTED TONER TRANSFER,"

U.S. Ser. No. 10/884,688, filed on even date herewith, entitled "METHOD AND APPARATUS FOR USING A TRANSFER ASSIST LAYER IN A TANDEM ELECTROPHOTOGRAPHIC PROCESS WITH ELECTROSTATICALLY ASSISTED TONER TRANSFER," and U.S. Ser. No. 10/884,339, filed on even date herewith, entitled "METHOD AND APPARATUS FOR USING A TRANSFER ASSIST LAYER IN A MULTI-PASS ELECTROPHOTOGRAPHIC PROCESS UTILIZING ADHESIVE TONER TRANSFER."

TECHNICAL FIELD

The present invention relates to methods and systems that enhance toner transfer for use with electrophotographic processes and particularly relates to the use of such methods and systems with liquid toner materials.

BACKGROUND OF THE INVENTION

Electrophotography forms the technical basis for various well-known imaging processes, including photocopying and some forms of laser printing. Other imaging processes use electrostatic or ionographic printing. Electrostatic printing is printing where a dielectric receptor or substrate is "written" upon imagewise by a charged stylus, leaving a latent electrostatic image on the surface of the dielectric receptor. This dielectric receptor is not photosensitive and is generally not reusable. Once the image pattern has been "written" onto the dielectric receptor in the form of an electrostatic charge pattern of positive or negative polarity, oppositely charged toner particles are applied to the dielectric receptor in order to develop the latent image. An exemplary electrostatic imaging process is described in U.S. Pat. No. 5,176,974.

In contrast, electrophotographic imaging processes typically involve the use of a reusable, radiation sensitive, temporary image receptor, known as a photoreceptor, in the process of producing an electrophotographic image on a final, permanent image receptor. A representative electrophotographic process involves a series of steps to produce an image on a receptor, including charging, exposure, development, transfer, fusing, cleaning, and erasure.

In the charging step, a photoreceptor is covered with charge of a desired polarity, either negative or positive, typically with a corona or charging roller. In the exposure step, an optical system, typically a laser scanner or diode array, forms a latent image by selectively exposing the photoreceptor to electromagnetic radiation, thereby discharging the charged surface of the photoreceptor in an imagewise manner corresponding to the desired image to be formed on the final image receptor. The electromagnetic radiation, which may also be referred to as "light" or actinic radiation, may include infrared radiation, visible light, and ultraviolet radiation, for example.

In the development step, toner particles of the appropriate polarity are generally brought into contact with the latent image on the photoreceptor, typically using an electrically-biased development roller to bring the charged toner particles into close proximity to the photoreceptive element. The polarity of the development roller should be the same as that of the toner particles and the electrostatic bias potential on the development roller should be higher than the potential of the imagewise discharged surface of the photoreceptor, so that the toner particles migrate to the photoreceptor and selectively develop the latent image via electrostatic forces, forming a toned image on the photoreceptor.

In the transfer step, the toned image is transferred from the photoreceptor to the desired final image receptor; an intermediate transfer element is sometimes used to effect transfer of the toned image from the photoreceptor with subsequent transfer of the toned image to a final image receptor. The transfer of an image typically occurs by one of the following two methods: adhesive assist (also referred to herein as "adhesive transfer") or electrostatic assist (also referred to herein as "electrostatic transfer").

Elastomeric assist or adhesive transfer refers generally to a process in which the transfer of an image is primarily caused by balancing the relative surface energies between the ink, a photoreceptor surface and a temporary carrier surface or medium for the toner. The effectiveness of such adhesive assist or adhesive transfer is controlled by several variables including surface energy, temperature, force, and toner rheology. An exemplary adhesive assist/adhesive image transfer process is described in U.S. Pat. No. 5,916,718.

Electrostatic assist or electrostatic transfer refers generally to a process in which transfer of an image is primarily affected by electrostatic charges or charge differential phenomena between the receptor surface and the temporary carrier surface or medium for the toner. Electrostatic transfer may be influenced by surface energy, temperature, and force, but the primary driving forces causing the toner image to be transferred to the final substrate are electrostatic forces. An exemplary electrostatic transfer process is described in U.S. Pat. No. 4,420,244.

In the fusing step, the toned image on the final image receptor is heated to soften or melt the toner particles, thereby fusing the toned image to the final receptor. An alternative fusing method involves fixing the toner to the final receptor under high force with or without heat. In the cleaning step, any residual toner remaining on the photoreceptor after the transfer step is removed. Finally, in the erasing step, the photoreceptor charge is reduced to a substantially uniformly low value by exposure to radiation of a particular wavelength band, thereby removing remnants of the original latent image and preparing the photoreceptor for the next imaging cycle.

Electrophotographic imaging processes may also be distinguished as being either multi-color or monochrome printing processes. Multi-color printing processes are commonly used for printing graphic art or photographic images, while monochrome printing is used primarily for printing text.

Some multi-color electrophotographic printing processes use a multi-pass process to apply multiple colors as needed on the photoreceptor to create the composite image that will be transferred to the final image receptor, either via an intermediate transfer member or directly. One example of such a process is described in U.S. Pat. No. 5,432,591.

In one exemplary electrophotographic, multi-color, multi-pass printing process, the photoreceptor takes the form of a relatively large diameter drum to permit an arrangement of two or more multi-color development units or units around the circumference perimeter of the photoreceptor. Alternatively, toners of varying colors can be contained in development units that are arranged on a moveable sled such that they can be individually moved into place adjacent to the photoreceptor as needed to develop a latent electrophotographic image. A single rotation of the photoreceptor drum generally corresponds to the development of a single color; four drum rotations and four sled movements are therefore required to develop a four color (e.g. full color) image. The multi-color image is generally built up on the photoreceptor in an overlaid configuration, and then the full color image is transferred with each color remaining in imagewise registration, to a final image receptor, either directly or via an intermediate transfer element.

In multipass processes utilizing a central photoreceptive element, it is important that the pigmented toner particles are transparent with respect to the radiation used to discharge the photoreceptive element. As the multiple colors are sequentially developed into a complete image on the photoreceptive element, it is frequently necessary to "layer" colors upon one another using an electrophoretic process that requires the photoreceptive element to remain sensitive to discharge-inducing radiation radiation even when one or more latent images have already been developed on the photoreceptive element. U.S. Pat. No. 5,916,718 describes this concept in greater detail.

In an exemplary electrophotographic, four-color, four-pass full color printing process, the steps of photoreceptor charging, exposure, and development are generally performed with each revolution of the photoreceptor drum, while the steps of transfer, fusing, cleaning, and erasure are generally performed once every four revolutions of the photoreceptor. However, multi-color, multi-pass imaging processes are known in which each color plane is transferred from the photoreceptor to an intermediate transfer element on each revolution of the photoreceptor. In these processes, the transfer, cleaning and erasure steps are generally performed upon each revolution of the photoreceptor, and the full-color image is built up on the intermediate transfer element and subsequently transferred from the intermediate transfer element to the final image receptor and fused.

Alternatively, electrophotographic imaging processes may be purely monochromatic. In these systems, there is typically only one pass per page because there is no need to overlay colors on the photoreceptor. Monochromatic processes may, however, include multiple passes where necessary to achieve higher image density or a drier image on the final image receptor, for example.

A single-pass electrophotographic process for developing multiple color images is also known and may be referred to as a tandem process. A tandem color imaging process is discussed, for example in U.S. Pat. Nos. 5,916,718 and 5,420,676. In a tandem process, the photoreceptor accepts color toners from development units that are spaced from each other in such a way that only a single pass of the photoreceptor results in application of all of the desired colors thereon.

In an exemplary four-color tandem process, each color may be applied sequentially to a photoreceptive element that travels past each development unit, overlaying each successive color plane on the photoreceptor to form the complete four-color image, and subsequently transferring the four-color image in registration to a final image receptor. For this exemplary process, the steps of photoreceptor charging, exposure, and development are generally performed four times, once for each successive color, while the steps of transfer, fusing, cleaning, and erasure are generally performed only once. After developing the four-color image on the photoreceptor, the image may be transferred directly to the final image receptor or alternatively, to an intermediate transfer member and then to a final image receptor.

In another type of multi-color tandem imaging apparatus, each individual color's development unit may include a small photoreceptor on which each color's contribution to the total image is plated. As an intermediate transfer member passes each photoreceptor, the image is transferred to the intermediate transfer member. The multi-color image is thereby assembled on the intermediate transfer element in overlaid registration of each individual colored toner layer, and subsequently transferred to the final image receptor.

Two types of toner are in widespread, commercial use: liquid toner and dry toner. The term "dry" does not mean that the dry toner is totally free of any liquid constituents, but connotes that the toner particles do not contain any significant amount of solvent, e.g., typically less than 10 weight percent solvent (generally, dry toner is as dry as is reasonably practical in terms of solvent content), and are capable of carrying a triboelectric charge. This distinguishes dry toner particles from liquid toner particles.

A typical liquid toner composition generally includes toner particles suspended or dispersed in a liquid carrier. The liquid carrier is typically a nonconductive dispersant, to avoid discharging the latent electrostatic image. Liquid toner particles are generally solvated to some degree in the liquid carrier (or carrier liquid), typically in more than 50 weight percent of a low polarity, low dielectric constant, substantially nonaqueous carrier solvent. Liquid toner particles are generally chemically charged using polar groups that dissociate in the carrier solvent, but do not carry a triboelectric charge while solvated and/or dispersed in the liquid carrier. Liquid toner particles are also typically smaller than dry toner particles. Because of their small particle size, ranging from about 5 microns to sub-micron, liquid toners are capable of producing very high-resolution toned images, and are therefore preferred for high resolution, multi-color printing applications.

A typical toner particle for a liquid toner composition generally comprises a visual enhancement additive (for example, a colored pigment particle) and a polymeric binder. The polymeric binder fulfills functions both during and after the electrophotographic process. With respect to processability, the character of the binder impacts charging and charge stability, flow, and fusing characteristics of the toner particles. These characteristics are important to achieve good performance during development, transfer, and fusing. After an image is formed on the final receptor, the nature of the binder (e.g. glass transition temperature, melt viscosity, molecular weight) and the fusing conditions (e.g. temperature, pressure and fuser configuration) impact durability (e.g. blocking and erasure resistance), adhesion to the receptor, gloss, and the like. Exemplary liquid toners and liquid electrophotographic imaging process are described by Schmidt, S. P. and Larson, J. R. in Handbook of Imaging Materials Diamond, A. S., Ed: Marcel Dekker: New York; Chapter 6, pp 227-252.

The liquid toner composition can vary greatly with the type of transfer used because liquid toner particles used in adhesive transfer imaging processes must be "film-formed" and have adhesive properties after development on the photoreceptor, while liquid toners used in electrostatic transfer imaging processes must remain as distinct charged particles after development on the photoreceptor.

Toner particles useful in adhesive transfer processes generally have effective glass transition temperatures below approximately 30° C. and volume mean particle diameter between 0.1-1 micron. In addition, for liquid toners used in adhesive transfer imaging processes, the carrier liquid generally has a vapor pressure sufficiently high to ensure rapid evaporation of solvent following deposition of the toner onto a photoreceptor, transfer belt, and/or receptor sheet. This is particularly true for cases in which multiple colors are sequentially deposited and overlaid to form a single image, because in adhesive transfer systems, the transfer is promoted by a drier toned image that has high cohesive strength (commonly referred to as being "film formed"). Generally, the toned imaged should be dried to higher than approximately 68-74 volume percent solids in order to be "film-formed" sufficiently to exhibit good adhesive transfer. U.S. Pat. No. 6,255,363 describes the formulation of liquid electrophotographic toners suitable for use in imaging processes using adhesive transfer.

In contrast, toner particles useful in electrostatic transfer processes generally have effective glass transition temperatures above approximately 40° C. and volume mean particle diameter between 3-10 microns. For liquid toners used in electrostatic transfer imaging processes, the toned image is preferably no more than approximately 30% w/w solids for good transfer. A rapidly evaporating carrier liquid is therefore not preferred for imaging processes using electrostatic transfer. U.S. Pat. No. 4,413,048 describes the formulation of one type of liquid electrophotographic toner suitable for use in imaging processes using electrostatic transfer.

Photoreceptors generally have a photoconductive layer that transports charge (by an electron transfer or hole transfer mechanism) when the photoconductive layer is exposed to activating electromagnetic radiation or light. The photoconductive layer is generally affixed to an electroconductive support, such as a conductive drum or an insulative substrate that is vapor coated with aluminum or another conductor. The surface of the photoreceptor can be either negatively or positively charged so that when activating electromagnetic radiation imagewise strikes the surface of the photoconductive layer, charge is conducted through the photoreceptor to neutralize, dissipate or reduce the surface potential in those activated regions to produce a latent image.

An optional barrier layer may be used over the photoconductive layer to protect the photoconductive layer and thereby extend the service life of the photoconductive layer. Other layers, such as adhesive layers, priming layers, or charge injection blocking layers, are also used in some photoreceptors. These layers may either be incorporated into the photoreceptor material chemical formulation, or may be applied to the photoreceptor substrate prior to the application of the photo receptive layer or may be applied over the top of photoreceptive layer. A "permanently bonded" durable release layer may also be used on the surface of the photoreceptor to facilitate transfer of the image from the photoreceptor to either the final substrate, such as paper, or to an intermediate transfer element, particularly when an adhesive transfer process is used. U.S. Pat. No. 5,733,698 describes an exemplary durable release layer suitable for use in imaging processes using adhesive transfer.

Many electrophotographic imaging processes make use of intermediate transfer members (ITM's) to assist in transferring the developed toner image to the final image receptor. In particular, in a multipass electrophotographic process, these ITM's may contact the final image formed on the photoreceptor to assist transfer of entire image to the ITM. The image may then be transferred from the ITM to the final image receptor, typically through contact between the ITM and the final receptor.

In a tandem process, individual photoreceptors layer the images formed by the component colors on the ITM. When the entire image is composed in this manner it is typically transferred to the final image receptor. However, U.S. Pat. No. 5,432,591, for example, discloses the use of an offset roller to remove the entire image from a photoreceptor and transfer it to the final image receptor in a multi-pass liquid electrophotographic process. In various embodiments, the ITM may be an endless belt, a roller or a drum.

One continuing problem in electrophotography is to ensure that the toner particles transfer efficiently from the photoreceptor to the final image receptor, either directly or indirectly using an intermediate transfer member. Frequently, a noticeable percentage of the toner layer is left behind at each transfer step, resulting in reduced image fidelity, low optical density and poor image quality on the final image receptor, and toner residues on various machine surfaces that must be efficiently cleaned. This problem of low transfer efficiency is particularly troublesome for liquid electrophotographic toners, wherein slight variations in the carrier liquid content of the toned image can control the efficiency of adhesive transfer or electrostatic transfer of the image from the photoreceptor or to a final image receptor.

Various attempts have been made to use transfer layers to assist transfer of liquid toned images from a temporary image receptor (e.g. a photoreceptor) or to a final image receptor (e.g. paper). For electrostatic or ionographic printing processes, a dielectric peel layer has been used to augment transfer from a temporary image receptor (see e.g. U.S. Pat. No. 5,176,974). Alternatively, an adhesive-coated protective laminating film has been used to augment transfer of liquid toners from a temporary electrographic receptor (see e.g. U.S. Pat. No. 5,370,960).

For liquid electrophotographic printing, a substantially continuous and uniform coating of a high viscosity or non-Newtonian liquid transfer layer has been applied to assist toner particle transfer from a photoreceptor and to a final image receptor using adhesive or adhesive transfer. A variety of peelable or releasable transfer assist films have also been used in liquid electrophotographic printing processes wherein the photoreceptor has a surface release characteristic and adhesive (adhesive) transfer is used to transfer the toned image from the photoreceptor surface. The peelable or releasable film is said to improve toner transferability, provide high quality and high fidelity multicolor images irrespective of the type of final image receptor or image receiving material, and improve storage stability of the final images (see e.g. U.S. Pat. Nos. 5,648,190, 5,582,941, 5,689,785 and 6,045,956).

Each of these methods for using a transfer assist material in a liquid electrophotographic printing process is directed to multipass processes that use adhesive or adhesive transfer of the image from a specially-prepared photoreceptor having a surface release character, either directly to a final image receptor or indirectly to an intermediate transfer element and then to the final image receptor. Each of these methods involves the application of the transfer assist material as a substantially uniform or continuous film on the photoreceptor. Because the transfer assist material is deposited not only where the toned image is developed, but also in non-imaged background areas, a portion of the transfer material ends up in the background regions on the final image receptor, adding to the expense of using the transfer assist material and potentially degrading the appearance of the final image on plain paper. The art continually searches for improved liquid toner transfer processes, and for methods and materials that allow liquid toner particles to transfer more completely, producing high quality, durable multicolor images on a final image receptor at low cost.

SUMMARY OF THE INVENTION

In one aspect of the invention a method of producing a composite image on a final image receptor from image data in a single pass electrophotographic system is provided. The method comprises the steps of providing a photoreceptive element and a transfer assist material development unit containing a liquid transfer assist material comprising transfer assist material particles dispersed in a first carrier liquid. The method further includes applying the transfer assist material to at least a portion of the surface of the photoreceptive element and presenting the photoreceptive element to at least one toner development unit comprising a toner, wherein the following steps (a) through (c) are performed in a single pass of the photoreceptive element: (a) applying a substantially uniform first electrostatic potential to the photoreceptive element; (b) selectively discharging the photoreceptive element in an imagewise manner to create a first latent image having a second electrostatic potential that is less than the absolute value of the first electrostatic potential; and (c) exposing the photoreceptive element to the toner comprising charged toner particles dispersed in a second carrier liquid, wherein the charged toner particles selectively deposit on the discharged portions of the surface of the photoreceptive element to develop the first latent image and create a toned image overlapping at least a portion of the transfer assist material on the surface of the photoreceptive element, wherein the transfer assist material and the toned image form a composite image layer on the photoreceptive element in the single pass of the photoreceptive element.

The method further includes substantially drying the composite image layer to remove at least a major portion of the second carrier liquid during the single pass of the photoreceptive element and contacting the composite image layer with a heated intermediate transfer member that provides a sufficient amount of heat and pressure to cause at least a portion of the substantially dried composite image layer to elastomerically transfer to the intermediate transfer member. The method also includes contacting the composite image layer on the intermediate transfer member with a first side of a final image receptor having two sides and applying force to the second side of the final image receptor with a backup element, causing the composite image layer to elastomerically transfer to the first side of the final image receptor. In another feature of the invention, a low surface energy transfer material is derived from an organosol containing charged dispersed particles derived from a silicone functional monomer.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE PREFERRED EMBODIMENTS

Effective transfer of liquid toner throughout the various necessary steps required in an electrophotographic process to reach a final substrate can present some challenges. In accordance with the present invention, the inclusion of a transfer assist layer or transfer assist material in certain tandem electrophotographic processes may provide certain advantages, depending on where in the tandem process this layer is used. A transfer assist layer, as described herein, is not necessarily any one specific material or type of material, although it is preferably a generally clear material, such as a nonpigmented ink. Whether the transfer assist material is visually "clear" or not, it is necessary, just as with pigmented toners, that if the transfer assist material is applied to or developed on the photoreceptive element prior to any pigmented toner layers, it is transparent with respect to the radiation used to discharge the photoreceptive element. In accordance with the present invention, it may be beneficial for a transfer assist layer to have release properties so that the transfer assist layer and the toner layers do not adhere to a photoreceptor, for one example. It is not a requirement that the layer provide release properties, however. A transfer layer may also have additional, unique benefits that add value and quality to a print aside from any problem-solving characteristics it may have, as will be discussed in further detail below.

Figure 1:
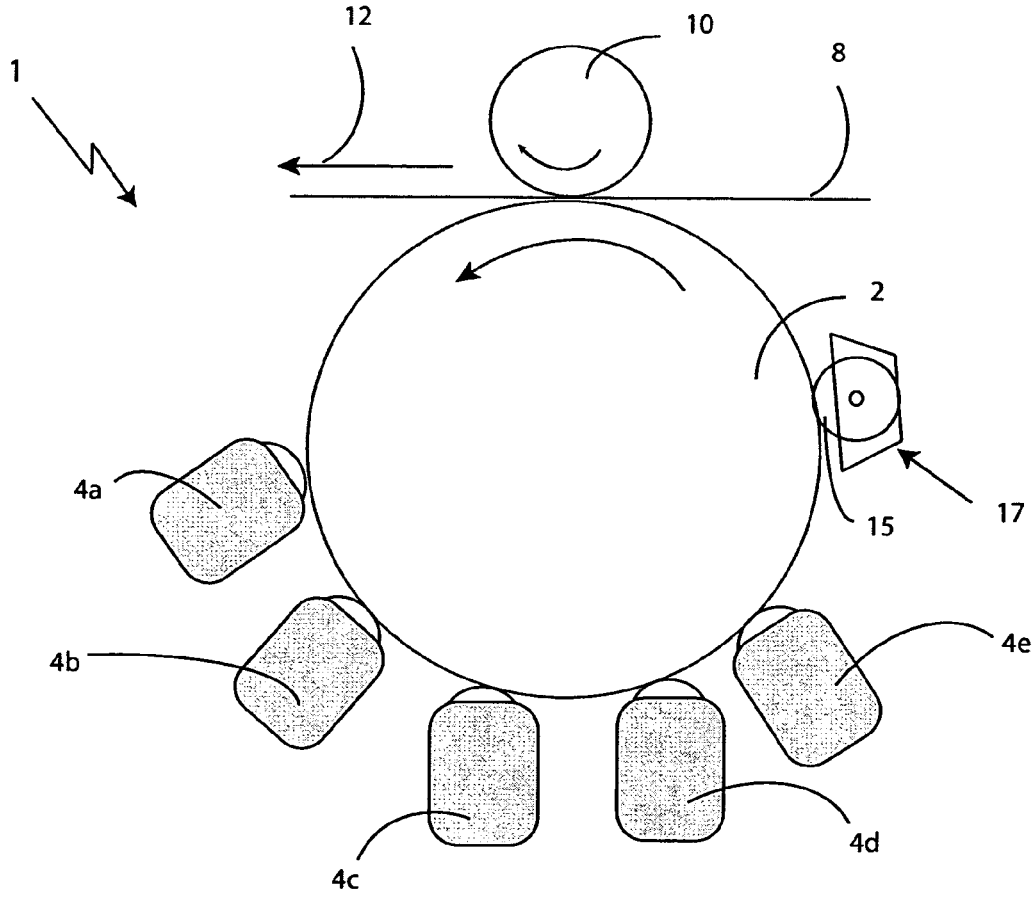
FIG. 1 is a schematic view of a portion of an electrophotographic apparatus using a tandem process for an adhesive transfer process, in accordance with the present invention.

The present invention will be further explained with reference to the appended Figures, wherein like structure is referred to by like numerals throughout the several views, and wherein FIG. 1 is a schematic drawing of the relevant parts of an electrophotographic apparatus 1 using a tandem development process that uses adhesive transfer. A photoreceptor 2 is included in the electrophotographic apparatus 1 and is positioned with multiple color development units 4*a*, 4*b*, 4*c*, 4*d*, and 4*e* that are held in place against the photoreceptor 2 throughout the entire printing process. When five development units are provided in a particular apparatus, it is preferable that four of the development units provide pigmented liquid ink material and that one development unit provides a transfer assist material. Further, while five development units are provided in this embodiment, more or less than five development units may be provided for a particular electrophotographic apparatus, with a wide variety of possible combinations of the number of development units containing liquid inks and the number of development units containing transfer assist materials within a single electrophotographic apparatus.

The photoreceptor 2 is shown in this non-limiting example as a drum, but may instead be a belt, a sheet, or some other photoreceptor configuration. The development units 4*a*-4*e* preferably each hold charged liquid ink or may contain a charged transfer assist material and include at least one development roller that attracts the charged pigmented ink particles or the non pigmented transfer assist material particles for application of the charged particles to discharged areas on the photoreceptor, as desired. This movement of the charged liquid ink particles onto the development roller is often referred to as electrophoretic development. The development roller, is typically rotated within its development unit to ensure even coverage of the liquid toner to the photoreceptor. U.S. Pat. Nos. 5,916,718 and 5,420,676 are examples of tandem electrophotographic processes using adhesive transfer, such as that of the present invention, which use development units such as the ones of the present invention, and are incorporated herein by reference. It is understood, however, that the development units used within the processes of the present invention may include a wide variety of different configurations and equipment for transferring ink to a photoreceptor.

The process and toner formulation considerations unique to tandem, adhesive transfer, electrophotographic processes are discussed, for example, in U.S. Pat. No. 5,650,253, which is incorporated herein by reference. The adhesive transfer technique operates without requiring differential charge levels to transfer the image from the photoreceptor to plain paper or to any intermediate transfer medium. The adhesive transfer technique relies on the characteristics of liquid toners used in the electrographic process, the relative surface energies between the surface of the photoreceptor, the liquid toners, an intermediate transfer media and the "plain" paper as well as certain temperatures and pressures. The two key considerations for adhesive (dry adhesive) transfer are heat (to raise the liquid ink to above its glass transition ($T_g$) temperature) and percentage of solids (how dry the toned image is). Generally, adhesive transfer processes encompass both direct transfer processes (toned image transfer is direct from the photoreceptive element to the final image receptor) and elastomeric transfer processes (toned images are transferred from a photoreceptive element to an elastomeric intermediate transfer member before being transferred to the final image receptor).

FIG. 1 shows multiple color development units 4*a*, 4*b*, 4*c*, 4*d*, and 4*e* in contact with the photoreceptor 2. The liquid toner or transfer assist materials (not shown) provided within the development units 4*a*, 4*b*, 4*c*, 4*d*, and 4*e* preferably have a charge director and are attracted to the discharged regions of the photoreceptor 2 when the photoreceptor 2 contacts one of the development units. Once the photoreceptor 2, which may be coated with a release layer, has received the liquid toner layers and any transfer assist materials, the composite image may be transferred directly to a final image receptor 8 that is traveling in the direction of arrow 12. In adhesive transfer systems, the liquid toner is carefully formulated so that much of the liquid carrier rapidly evaporates or is removed from the image and the liquid toner (or toned image) forms a film on the surface of the photoreceptor. The liquid toned image on the photoreceptor 2 may be dried by a drying mechanism 17 (which is disclosed, for example, in U.S. Pat. No. 5,650,253) which may include an absorptive/adsorptive roller 15, vacuum box (not shown) or heat curing unit (not shown). The drying mechanism 17 may be passive, may utilize active air blowers or may be other active devices such as absorbent rollers 15, as seen here. Such an apparatus is described in U.S. Pat. No. 5,420,675, for example, which is hereby incorporated by reference. The drying mechanism 17 transforms liquid ink into a substantially dry ink film. The "solid" portion (ink film) that remains plated upon the surface of the photoreceptor 2 matches the previous image-wise charge distribution previously placed upon the surface of photoreceptor 2 and forms a developed electrostatic image. The toned image, which is now an ink film, representing the desired image to be printed, may then be transferred directly to the final image receptor 8. Transfer is effected by differential tack of the ink film and the photoreceptor surface 2. Typically, heat and/or pressure may be utilized to fuse the image to the final image receptor 8.

One way this adhesive transfer process may be accomplished is by using a liquid toner that has a very low $T_g$ that will form a film at room temperature. If a higher $T_g$ ink formulation is used, the photoreceptor may be heated to cause the liquid carrier to evaporate or the toner particles to coalesce, and the image to film form. The backup roller 10 may also be heated. As the final image receptor 8 passes between the photoreceptor 2 (which may or may not be heated) and the heated backup roller 10, the toned image, which is now a film, is melted into the texture of the final image receptor 8. When the photoreceptor 2 is coated with a release layer (such as that disclosed in U.S. Pat. No. 5,650,253, cited above), the toned image film will transfer relatively easily to the final image receptor 8. In any case, so long as the surface energy of the final image receptor 8 is greater than that of the photoreceptor 2, the image is likely to transfer. In electrophotographic systems that use adhesive transfer and do not use an elastomeric intermediate transfer member (e.g., direct transfer is used), toner film thickness and compliance are important to successful transfer and quality images. This is especially true with respect to a final image receptor, such as plain paper, that is rough and has a relatively uneven surface.

One example of a liquid toner formulation for use in electrophotographic systems that use adhesive transfer is seen in U.S. Pat. No. 5,650,253. One type of ink found particularly suitable for use as liquid inks consists of ink materials that are substantially transparent and of low absorptivity to radiation from laser scanning devices. This allows radiation from laser scanning devices to pass through the previously deposited ink or inks and impinge on the surface of photoreceptor 2 and reduce the deposited charge. This type of ink permits subsequent imaging to be effected through previously developed ink images as when forming a second, third, or fourth color plane without consideration for the order of color deposition. It is preferable that the inks transmit at least 80% and more preferably 90% of radiation from the laser scanning devices and that the radiation is not significantly scattered by the deposited ink material of the liquid inks.

One type of ink found particularly suitable for use in this process are gel organosols which exhibit excellent imaging characteristics in liquid immersion development. For example, the gel organosol liquid inks exhibit low bulk conductivity, low free phase conductivity, low charge/mass and adequate mobility, which are all desirable characteristics for producing high resolution, background free images with high optical density. In particular, the low bulk conductivity, low free phase conductivity and low charge/mass of the inks allow them to achieve high developed optical density over a wide range of solids concentrations, thus improving their extended printing performance relative to conventional inks.

These color liquid inks, upon development, form colored films that transmit incident radiation such as, for example, near infrared radiation, consequently allowing the photoconductor layer to discharge, while non-coalescent particles scatter a portion of the incident light. Non-coalesced ink particles therefore result in the decreasing of the sensitivity of the photoconductor to subsequent exposures and consequently there is interference with the overprinted image.

These inks preferably have relatively low $T_g$ values which enable the inks to form films at room temperature. In these cases, normal room temperature (19°-23° C.) is sufficient to enable film forming and the ambient internal temperatures of the apparatus during operation, which tends to be at a higher temperature (e.g., 25°-40° C.) even without specific heating elements, is sufficient to cause the ink or allow the ink to form a film.

Residual image tack after transfer may be adversely affected by the presence of high tack monomers, such as ethyl acrylate, in the organosol. Therefore, the organosols are generally formulated such that the organosol core preferably has a glass transition temperature ($T_g$) less than room temperature (25° C.) but greater than −10° C. A preferred organosol core composition contains about 75 weight percent ethyl acrylate and 25 weight percent methyl methacrylate, yielding a calculated core $T_g$ of about −1° C. This permits the inks to rapidly self-fix under normal room temperature or higher development conditions and also produces tack-free fixed images that resist blocking.

The carrier liquid may be selected from a wide variety of materials which are well known in the art. The carrier liquid is typically oleophilic, chemically stable under a variety of conditions, and electrically insulating. Electrically insulating means that the carrier liquid has a low dielectric constant and a high electrical resistivity. Preferably, the carrier liquid has a dielectric constant of less than 5, and still more preferably less than 3. Examples of suitable carrier liquids are aliphatic hydrocarbons (n-pentane, hexane, heptane and the like), cycloaliphatic hydrocarbons (cyclopentane, cyclohexane and the like), aromatic hydrocarbons (benzene, toluene, xylene and the like), halogenated hydrocarbon solvents (chlorinated alkanes, fluorinated alkanes, chlorofluorocarbons and the like), silicone oils and blends of these solvents. Preferred carrier liquids include paraffinic solvent blends sold under the names Isopar G liquid, Isopar H liquid, Isopar K liquid, Isopar L liquid. Norpar™ 13 liquid, and Norpar™ 15 liquid (manufactured by Exxon Chemical Corporation, Houston, Tex.). The preferred carrier liquid is Norpar™ 12 liquid, also available from Exxon Corporation.

The toner particles used in the liquid inks are preferably comprised of colorant embedded in a thermoplastic resin. The colorant may be a dye or more preferably a pigment. The resin may be comprised of one or more polymers or copolymers that are characterized as being generally insoluble or only slightly soluble in the carrier liquid; these polymers or copolymers comprise a resin core. In addition, superior stability of the dispersed toner particles with respect to aggregation is obtained when at least one of the polymers or copolymers (denoted as the stabilizer) is an amphipathic substance containing at least one chain-like component of molecular weight at least 500 which is solvated by the carrier liquid. Under such conditions, the stabilizer extends from the resin core into the carrier liquid, acting as a steric stabilizer as discussed in Dispersion Polymerization (Ed. Barrett, Interscience., p. 9 (1975)). Preferably, the stabilizer is chemically incorporated into the resin core, i.e., covalently bonded or grafted to the core, but may alternatively be physically or chemically adsorbed to the core such that it remains as an integral part of the resin core.

The composition of the resin is preferentially manipulated such that the organosol exhibits an effective glass transition temperature ($T_g$) of less than 25 degrees Celsius (more preferably less than 6 degrees Celsius), thus causing an ink composition of liquid inks containing the resin as a major component to undergo rapid film formation (rapid self fixing) in printing or imaging processes carried out at temperatures greater than the core $T_g$ (preferably at or above 25 degrees Celsius). The use of low $T_g$ resins to promote rapid self fixing of printed or toned images is known in the art, as exemplified by Film Formation (Z. W. Wicks, Federation of Societies for Coatings Technologies, p. 8 (1986)). Rapid self fixing is thought to avoid printing defects (such as smearing or trailing-edge tailing) and incomplete transfer in high speed printing. For printing on plain paper, it is preferred that the core $T_g$ be greater than minus 10 degrees Celsius and, more preferably, be in the range from minus 5 degrees Celsius to plus 5 degrees Celsius so that the final image is not tacky and has good blocking resistance.

Such rapid self fixing is required of liquid inks to enable the liquid inks applied first in the process to film form before being subjected to overlay by a subsequent liquid ink in the formation of a subsequent color plane of the image. It is preferred that liquid inks self fix within 0.5 seconds to enable the apparatus to operate at sufficient speed and to ensure image quality. It is generally believed that such rapid self fixing will occur in liquid inks which have greater than 75 percent volume fraction of solids in the image.

It is also preferred that the glass transition temperature ($T_g$) of the liquid inks be greater than minus ten degrees Celsius and less than plus 25 degrees Celsius so that the final image is not tacky and has good blocking resistance. More preferred is a $T_g$ between minus 5 degrees Celsius and plus 5 degrees Celsius.

It is also preferred that the liquid inks have a low charge to mass ratio which assists in giving the resultant image high density. It is preferred that liquid inks have a charge to mass ratio of from 0.025 to 0.1 microcoulombs/(centimeters$^2$–OD). Liquid inks have a charge to mass ratio of from 0.05 to 0.075 microcoulombs/(centimeters$^2$–OD) in the most preferred embodiment. (This is the charge per developed optical density, which is directly proportional to charge per mass.) It is also preferred that the liquid inks have a low free phase conductivity which aids in providing high resolution, gives good sharpness and low background. It is preferred that the free phase conductivity is less than 30 percent at 1 percent solids. It is still more preferred that the free phase conductivity is less than 20 percent at 1 percent solids. A free phase conductivity of less than 10 percent at 1 percent solids is most preferred.

Examples of resin materials suitable for use in the liquid inks include polymers and copolymers of (meth)acrylic esters; including methyl acrylate, ethyl acrylate, butyl acrylate, ethylhexyl acrylate, 2-ethylhexylmethacrylate, lauryl acrylate, octadecyl acrylate, methyl methacrylate, ethyl methacrylate, lauryl methacrylate, 2-hydroxy ethyl methacrylate, octadecyl methacrylate and other polyacrylates. Other polymers may be used in conjunction with the aforementioned materials, including melamine and melamine formaldehyde resins, phenol formaldehyde resins, epoxy resins, polyester resins, styrene and styrene/acrylic copolymers, acrylic and methacrylic esters, cellulose acetate and cellulose acetate-butyrate copolymers, and poly(vinyl butyral) copolymers.

The colorants which may be used in the liquid inks include virtually any dyes, stains or pigments which may be incorporated into the polymer resin, which are compatible with the carrier liquid, and which are useful and effective in making visible the latent electrostatic image. Examples of suitable colorants include: Phthalocyanine blue (C.I. Pigment Blue 15 and 16), Quinacridone magenta (C.I. Pigment Red 122, 192, 202 and 206), Rhodamine YS (C.I. Pigment Red 81), diarylide (benzidine) yellow (C.I. Pigment Yellow 12, 13, 14, 17, 55, 83 and 155) and arylamide (Hansa) yellow (C.I. Pigment Yellow 1, 3, 10, 73, 74, 97, 105 and 111); organic dyes, and black materials such as finely divided carbon and the like.

The optimal weight ratio of resin to colorant in the toner particles is on the order of 1/1 to 20/1, most preferably between 10/1 and 3/1. The total dispersed "solid" material in the carrier liquid typically represents 0.5 to 20 weight percent, most preferably between 1 and 5 weight percent of the total liquid development composition.

The liquid inks include a soluble charge control agent, sometimes referred to as a charge director, to provide uniform charge polarity of the toner particles. The charge director may be incorporated into the toner particles, may be chemically reacted to the toner particle, may be chemically or physically adsorbed onto the toner particle (resin or pigment), and may be chelated to a functional group incorporated into the toner particle, preferably via a functional group comprising the stabilizer. The charge director acts to impart an electrical charge of selected polarity (either positive or negative) to the toner particles. Any number of charge directors described in the art may be used herein; preferred positive charge directors are the metallic soaps. See U.S. Pat. No. 3,411,936, Rotsman et al. The preferred charge directors are polyvalent metal soaps of zirconium and aluminum, preferably zirconium octoate.

Other additives may also be added to the formulation in accordance with conventional practices. These include one or more of UV stabilizers, mold inhibitors, bactericides, fungicides, antistatic agents, gloss modifying agents, other polymer or oligomer material, antioxidants, and the like.

In accordance with the present invention, the liquid inks described herein may have a tendency to stick or adhere to the various surfaces of the apparatus, or to exhibit cohesive weakness with respect to the ink film, or to exhibit adhesive weakness with respect to the final image receptor, any of which are generally undesirable. Thus, it is advantageous to use a transfer assist layer material to minimize the chances of such behavior of the liquid inks. This transfer assist layer material may consist of a wide variety of materials, such as for example, the transfer assist layer material may be an organosol of the type described above; however, the organosol layer would then preferably not include any pigment (i.e., nonpigmented organosol). The transfer assist layer material may or may not include a charge director, as will be seen below. In addition, the transfer assist material may have the same glass transition temperature as the inks that are used in the same apparatus so that the transfer assist material will film form as part of the complete layer that includes the ink materials. The transfer assist layer material may alternatively have a different glass transition temperature than that of the inks. For one example, the transfer assist material may have a glass transition temperature that is higher than that of the ink layers so that the transfer assist material will not film form to the same extent as the ink layers. In this case, the layers may be less likely to completely release from the various rollers, although it may be desirable in such cases to add various release agents to the transfer assist layer material.

One advantage of a tandem electrophotographic process is that multiple colors may be laid on top of one another in sequence with a single rapid pass of the photoreceptor 2 past multiple development units. Referring again to FIG. 1, once the photoreceptor 2 has received the liquid toner layers and any transfer assist layers, the composite image may be transferred directly to a final image receptor 8 that is traveling in the direction of arrow 12.

In accordance with the present invention, at least one of the development units 4*a*-4*e* contains a transfer assist layer for application to the photoreceptor 2. The selection of the development unit 4*a*-4*e* in which the transfer assist layer will be placed is made based on a variety of factors, as will be described below.

In this process, because the liquid toner development units 4*a*, 4*b*, 4*c*, 4*d*, 4*e* are in constant contact the photoreceptor 2, in a relatively fixed position, the transfer assist material will be placed in one of the development units in sequence within the imaging process in the order in which the transfer assist layer or layers should be laid. In other words, a development unit containing transfer assist material will preferably be positioned relative to the photoreceptor and the other development units in the particular locations that allow the desired layering of pigmented inks and transfer assist materials.

The other development units of a particular electrophotographic apparatus preferably contain the colors cyan (C), magenta (M), yellow (Y), and black (K), but the colors in each development unit may include any colors including, for example, a red (R), green (G), blue (B), and black (K) system, or other variations. In accordance with the present invention, it is understood that any toner layer or image may include one or more colors or layers, but such layers and images are generally shown and described herein as a single toner layer, for clarity of description and illustration. Based on in which development unit the transfer assist layer is placed, the transfer assist material may be applied to the photoreceptor 2 before the colored toners are applied (for example, by placing the transfer assist layer in development unit 4*a*), or over the toned image, as described below (for example, by placing the transfer assist layer in development unit 4*e*).

Figure 2A:
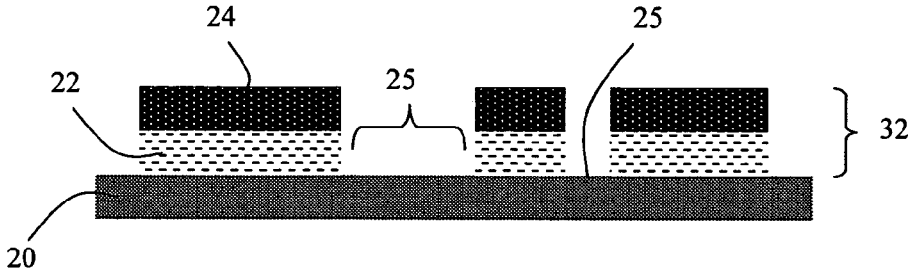
FIGS. 2*a* and 2*b* are side schematic views of an arrangement of toner and transfer assist layers in the steps involving toner transfer from a photoreceptor to a final receptor, wherein a transfer assist layer is applied to the photoreceptor before an ink/toner layer is applied.
Figure 2B:
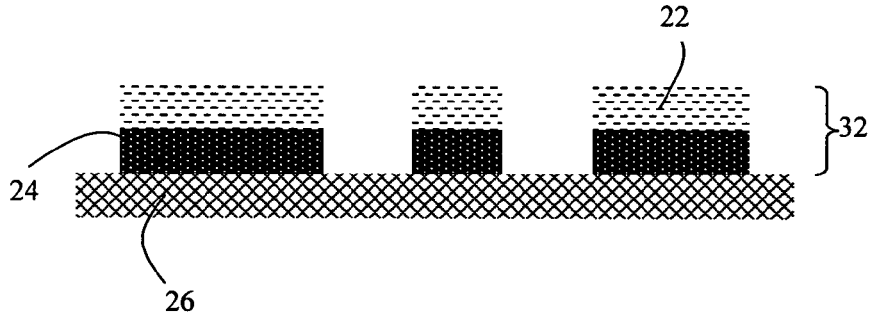

FIG. 2*a* shows a transfer assist layer 22 as applied or positioned on a photoreceptor 20, as applied by an apparatus such as apparatus 1 of FIG. 1. A toner layer 24, which may include one or more colors applied in any desired sequence, is applied or positioned so that it at least partially covers the transfer assist layer 22. FIG. 2*b* illustrates this arrangement of the layers of FIG. 2*a* in its configuration after the image is transferred to a final image receptor 26. When the transfer assist layer 22 is placed on the photoreceptor 20 before the toner layer or layers 24, as in this embodiment, transfer of the image to the final receptor 26 places the toner layer 24 in direct contact with the final receptor 26 and places the transfer assist layer 22 on the outside. The combination of the transfer assist layer 22 and the toner layer 24 is labeled herein as a total image layer 32.

The schematic of FIG. 2*a* shows a preferred embodiment where the transfer assist material 22 comprises charged particles and has been, for example, electrophoretically developed to select portions of the photoreceptive element 20. The at least one pigmented toner layer 24 is subsequently electrophoretically developed over the transfer assist material 22. Areas that will not receive any pigment toner 25 also do not receive any transfer assist material.

When the transfer assist layer 22 is applied to the photoreceptor 20 before the toner layer or layers 24 in this way, the layer 22 may provide any of several advantages. In electrophotographic apparatuses that use adhesive transfer processes, the pigmented toner particle size is not critical, except as an image resolution factor. Because the toner particles coalesce into a cohesive film, the individual particle size does not substantially affect transfer. However, particle size may be constrained simply because smaller toner particles (sub-micron) tend to produce higher resolution images. Because, in this embodiment the transfer assist material is a non-pigmented, film-forming liquid ink, it may bond cohesively with the pigmented ink layers to promote cohesion, thereby assisting in transfer.

Figure 3A:
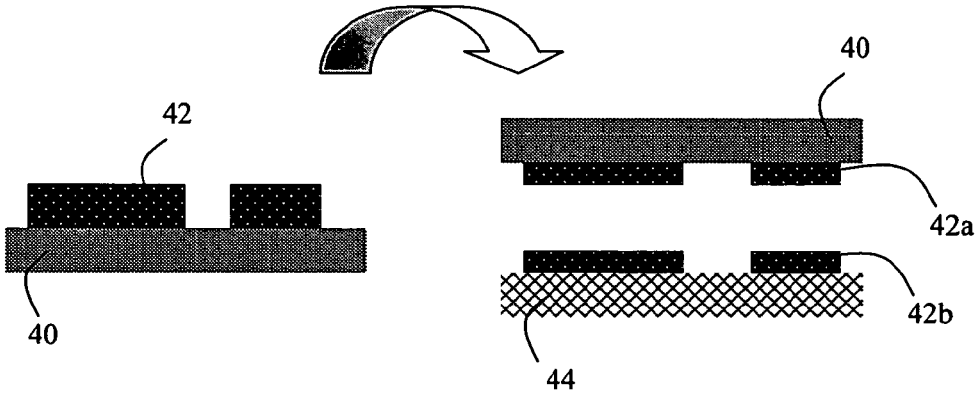
FIGS. 3*a* and 3*b* are side schematic views of toner and transfer assist layers arranged relative to each other, including splitting of layers with and without the use of a transfer assist layer.
Figure 3B:
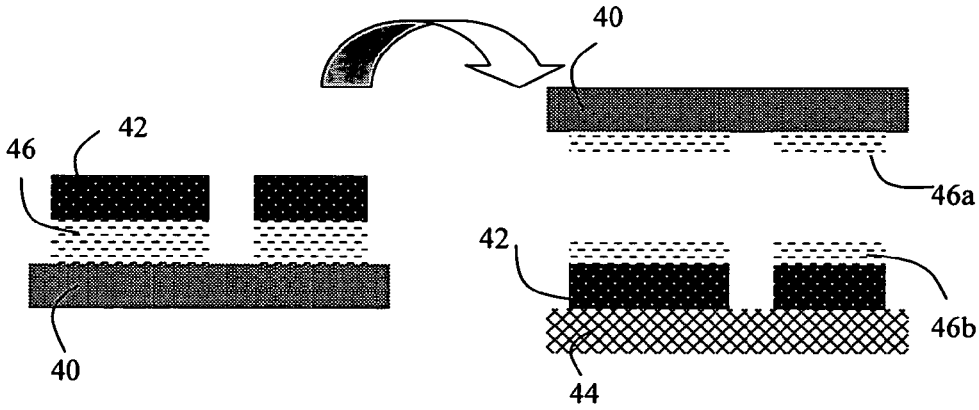

In some cases, a transfer assist layer may not provide complete release from a photoreceptor or other surface, such as is illustrated in FIGS. 2*a* and 2*b*. In FIGS. 3*a* and 3*b*, for example, the transfers of an image with and without a transfer assist layer are illustrated, where FIG. 3*b* shows the use of a transfer assist layer as a "sacrificial layer". First, in FIG. 3*a*, a photoreceptor 40 is shown having a toned image (toner film) 42 thereon. As indicated by the arrow, the second step of this process shows transfer of that image to a final receptor 44 in which the entire toner film 42 does not transfer. This figure shows that if there is incomplete toner transfer, only a portion of the toner film 42 is transferred to the final receptor 44 and is shown as a layer 42*b* (a partial layer). The portion 42*a* that remains behind on the photoreceptor 40 is toner that contributed to the quality and optical density of the image. The result can be an image on a final substrate having diminished optical quality and a "papery" or mottled appearance due to the presence of scattered microvoids or small patches of missing toner in the image. A similar problem that is not illustrated here, is where a portion of the film formed image transfers at 100% while one or more portions transfer at 0%, leaving holes or voids in the image film on the final substrate.

FIG. 3*b* shows the same phenomenon as shown in FIG. 3*a*, but with the use of a transfer assist layer. In accordance with the present invention, a photoreceptor 40 with a layer of transfer assist material 46 and a toner film 42 is provided. As indicated by the arrow, the second step of this process occurs when it becomes necessary to transfer the image to the final substrate. As shown in this figure, the transfer assist layer 46 may or may not form a film, but "splits" or divides in such a way that a portion of the transfer assist layer 46*b* goes with the toner film 42 to the final image receptor 44, and a portion of the transfer assist layer 46*a* remains behind on the photoreceptor 40. Advantageously, the entire toner image layer 42 is thereby transferred to the final image receptor 44, thereby assisting in maintaining a desirable optical density of the image or the cohesive strength of the toner film. This phenomenon may occur whether the transfer assist layer film forms on the photoreceptor or not.

One advantage that this embodiment of the transfer assist layer may have is as a release layer, with some or all of the transfer assist layer transferring to the final image receptor 44 with the pigmented toner particles of the final image. One way this may be accomplished is by using an organosol to create a transfer assist layer that has a higher $T_g$ than the liquid ink. The higher $T_g$ layer would provide release from the photoreceptor surface, while promoting cohesion among the toner particles of the image, as they film form before transfer. Some examples of transfer assist materials that can be used for release and may be incorporated into a higher $T_g$ organosol include silicone macromers and polydimethylsiloxanes. U.S. Pat. Nos. 5,604,070, 5,919,866, and 5,521,271 provide lists of examples of polymeric dispersions that include surface release promoting moieties and are hereby incorporated by reference. Transfer assist layers used as a release may or may not have film forming characteristics that match that of the liquid ink otherwise used in the apparatus.

This process may have additional advantages not related to transfer assistance. For example, a transfer assist layer may have additives to make it a durable image protectant when the image is fixed or fused to the final receptor. Examples of such additives include organosols that incorporate high $T_g$ monomers, such as TCHMA, isobornylacrylate, or isobornylmethacrylate, (as is described, for example, in co-pending U.S. patent application of the present Assignee Ser. No. 10/612,765, filed Jun. 30, 2003, entitled "ORGANOSOL INCLUDING HIGH TG AMPHIPATHIC COPOLYMERIC BINDER AND LIQUID TONERS FOR ELECTROPHOTOGRAPHIC APPLICATIONS" the entire content of which is incorporated herein by reference, or that incorporate covalently bonded polymerizable, crystallizable monomers such as acrylates or methacrylates with carbon numbers including and between $C_{16}$ and $C_{26}$ (e.g., hexadecyl-acrylate or -methacrylate, stearyl-acrylate or -methacrylate, or behenyl-acrylate or -methacrylate) (as is described, for example, in co-pending U.S. patent application of the present Assignee Ser. No. 10/612,534, filed Jun. 30, 2003, entitled "ORGANOSOL LIQUID TONER INCLUDING AMPHIPATHIC COPOLYMERIC BINDER HAVING CRYSTALLINE COMPONENT", the entire content of which is incorporated herein by reference). The transfer assist layer can also be adjusted to have properties that, for example, offer abrasion resistance or protection from ultraviolet radiation. It can also be modified to provide a glossy surface, enhancing the way the image looks on the final receptor. These features are not requirements of an effective transfer assist layer, but they could be elements of an enhanced transfer assist layer that solves other imaging problems or defects.

As discussed above with respect to FIG. 1, the transfer assist material may be placed in any development unit position (4*a*, 4*b*, 4*c*, 4*d*, or 4*e*) for plating to the photoreceptor 2. However, the embodiments described above include processes in which the development unit containing the transfer assist material applies the transfer assist material to the photoreceptor prior to the application of any toner materials, for example, in development unit 4*a*. The transfer assist layer material may instead be applied to the photoreceptor 2 after the toned image is layered on the photoreceptor, for example in development unit 4*e*, as described below. In such an embodiment, the final development unit may be placed after the drying unit (shown as 15, 17 in FIG. 1) if a less dry transfer assist layer is desired.

Figure 4A:
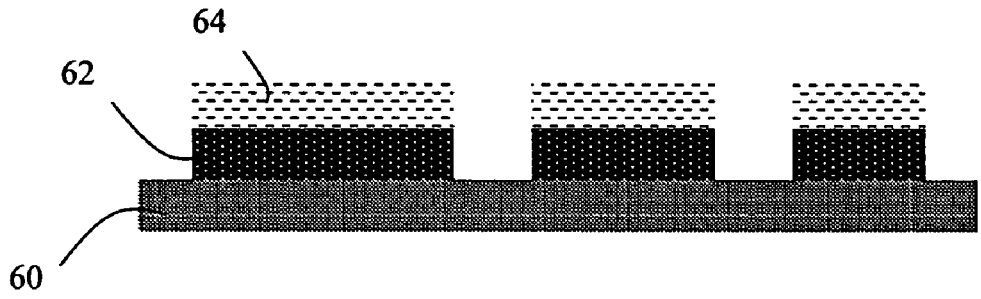
FIGS. 4*a* and 4*b* are side schematic views of an arrangement of toner and transfer assist layers in the steps involving toner transfer from a photoreceptor to a final receptor, wherein a transfer assist layer is applied to the photoreceptor after an ink/toner layer is applied.
Figure 4B:
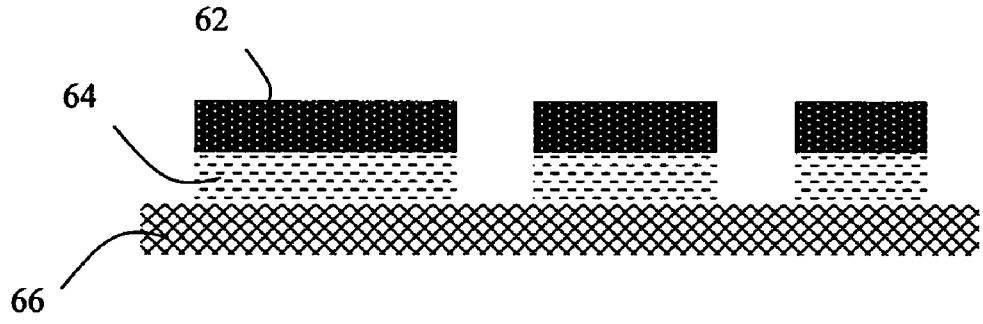

FIGS. 4*a* and 4*b* illustrate another embodiment of the present invention in which the layers and the transfer steps are shown for a process wherein a transfer assist layer is initially placed over the toned image. In particular, FIG. 4*a* shows a photoreceptor 60, with a complete toned image positioned thereon made up of at least one toner film 62 and a transfer assist layer 64 at least partially covering the toner film/layer 62. When the image is then transferred to the final receptor 66 (as shown in FIG. 4*b*), the transfer assist layer 64 contacts the final image receptor 66 and the toner film 62 is on the outside (i.e., the toner film 62 is the top layer).

This embodiment of FIGS. 4*a* and 4*b* illustrates the improved transfer efficiency that may be achieved through the use of a transfer assist layer in this position. In particular, this transfer efficiency may be enhanced due to properties of the transfer assist layer that enhance the cohesive strength of the toner film 62 and the adhesive strength of the ink film 62 to the final receptor 66. One way this can work is by choosing a transfer assist material that incorporates high surface energy or polar monomers such as amino functional acrylates as discussed in co-pending U.S. patent applications Ser. Nos. 10/013,635 and 10/334,398, which are hereby incorporated by reference. A transfer assist layer used in this way does not necessarily promote transfer efficiency by providing a layer for release or splitting from the photoreceptor. However, in this embodiment, the transfer assist layer can be used as an adhesive to bond the ink film to the final image receptor, thereby creating stronger cohesive strength within the final image and better adhesion to the final image substrate. One way this may be achieved is by the use of a transfer assist layer having a very low $T_g$ of −1° C. or less. Another way this may be achieved is through the addition of "sticky" acrylates, such as NN-dimethylaminoethyl acrylate, for example. Additionally, this embodiment might be particularly useful with respect to the printing of liquid toners on overhead projection film (OHP film), for example.

Figure 5A:
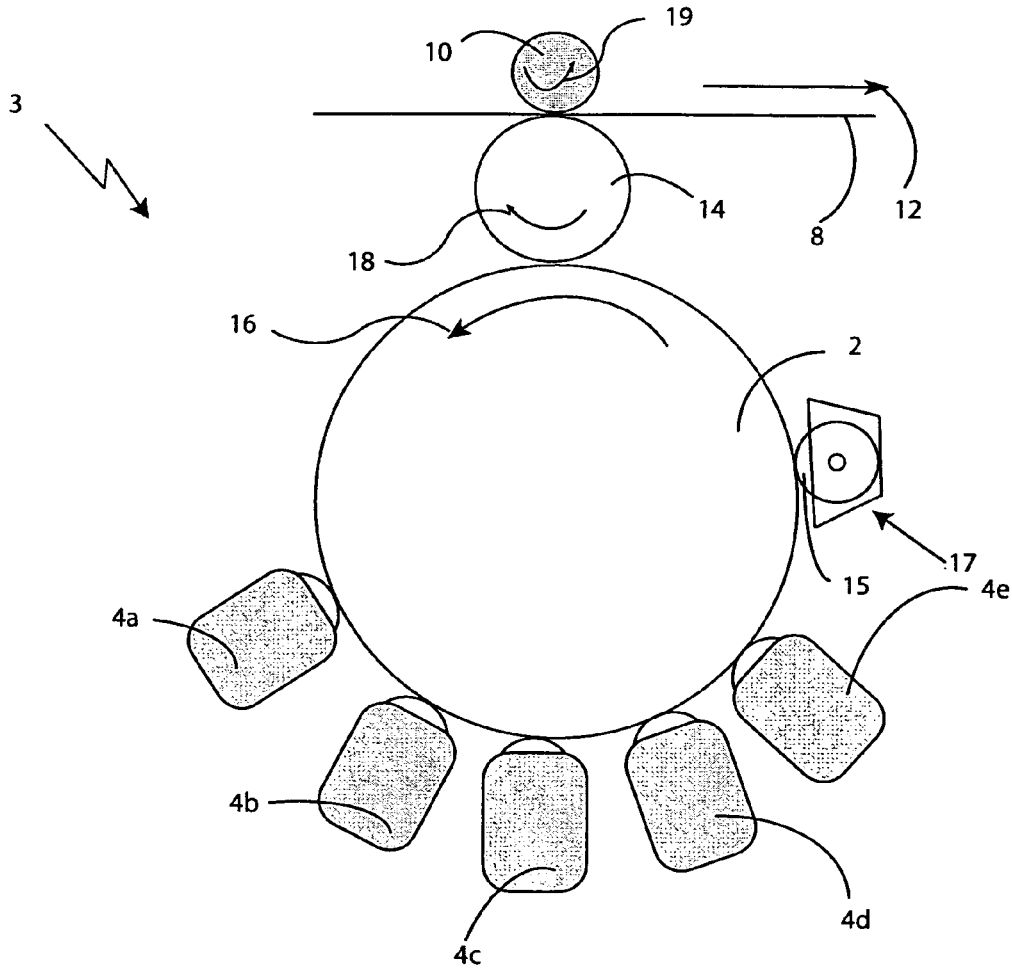
FIG. 5*a* is a schematic view of a portion of an electrophotographic apparatus using a tandem process that uses adhesive transfer and an intermediate transfer member.
Figure 5B:
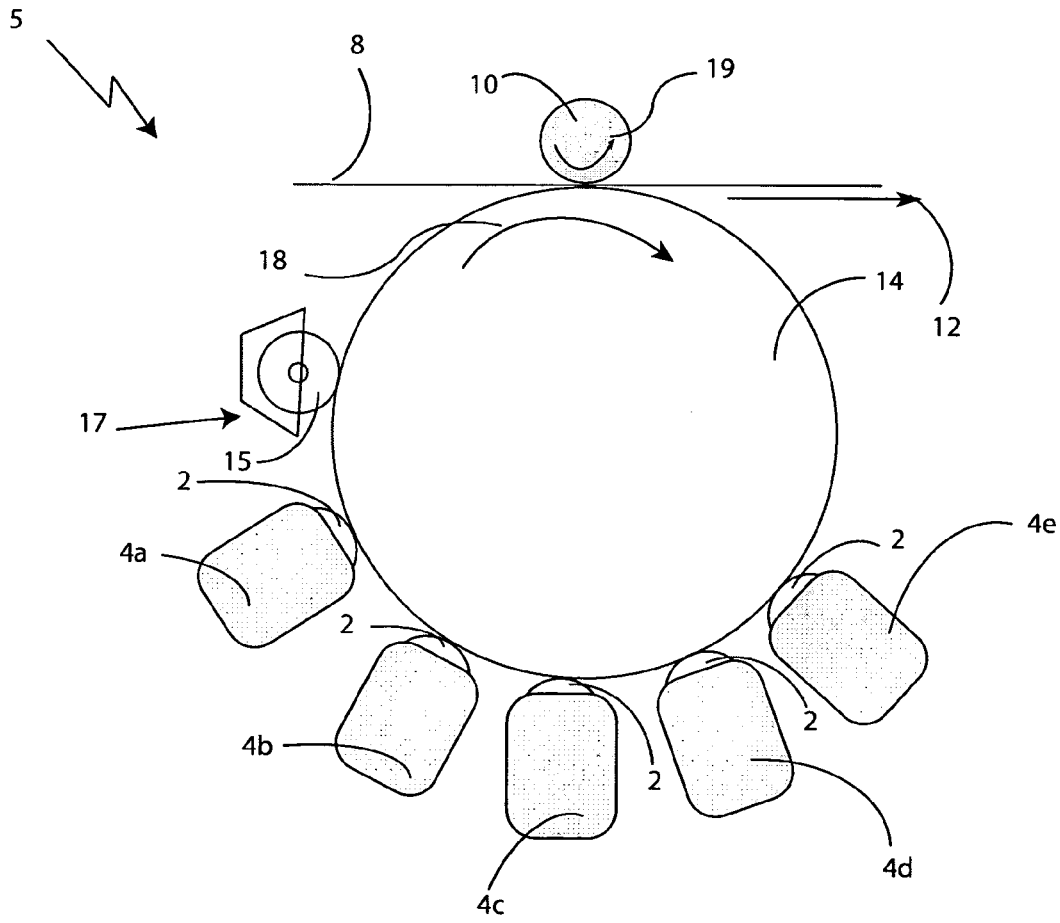
FIG. 5*b* is a schematic view of a portion of an electrophotographic apparatus, with each development unit having its own photoreceptor.

FIGS. 5*a* and 5*b* show two embodiments of electrophotographic apparatuses 3 and 5, respectively, in accordance with the present invention, which are similar to the apparatus of FIG. 1. The apparatuses 3 and 5 additionally incorporate the use of an intermediate transfer member 14 positioned between a photoreceptor 2 and a transfer roller 10. In FIG. 5*a*, a photoreceptor 2 is included in the electrophotographic apparatus 3 and is positioned so that multiple development units 4*a*, 4*b*, 4*c*, 4*d*, and 4*e* are situated against the photoreceptor 2 at all times. While five development units are provided in this embodiment, more or less than five development units may be provided for a particular electrophotographic apparatus. The photoreceptor 2 is shown in this non-limiting example as a drum, but may instead be a belt, a sheet, or some other photoreceptor configuration.

In a single pass in this tandem process, the desired number of toner layers are applied to the photoreceptor 2 by the various development units in less than one revolution of the photoreceptor (such as when the photoreceptor is a drum), to create a total toned image. The total toned image is then transferred to the intermediate transfer member 14 (shown here as an intermediate transfer member, but which may be a sheet, drum, or belt) before transfer to the final image receptor 8 ("elastomeric transfer").

Referring to FIG. 5*a*, the "solid" color pigments of the liquid inks preferably form a film with sufficient cohesive strength on the surface of photoreceptor 2 before or during transfer to intermediate transfer member 14. The image consisting of a cohesive film comprised of as many as four layers of the "solid" color pigments of the liquid inks can be formed into a substantially dry, composite ink film by using, for example, a drying roller 15 or other drying device 17. Preferably, the drying roller 15 is a silicone-coated roller that absorbs any remaining liquid. The drying roller 15 further dries, or "conditions" for subsequent transfer, by a drying unit which may alternatively be constructed of a conventional hot air blower or other conventional means.

The composite image is then transferred in a single step to an intermediate transfer member 14 for subsequent transfer to the final image receptor 8. The composite image on the surface of the photoreceptor 2 is brought into pressure contact with intermediate transfer member 14 that is constructed of an elastomer, preferably fluorosilicone, heated to temperature T1. Temperature T1 can be in the range of 25-130 degrees Celsius and, preferably from 50-100 degrees Celsius, most preferably about 90 degrees Celsius. At temperature T1, a tack develops between the elastomer of the intermediate transfer member 14 and the liquid ink film. Although a roller is preferred for the intermediate transfer member 14, a belt is also envisioned. In one example, the preferred force for contact between the intermediate transfer member 14 and photoreceptor 2 is 70 pounds (32 kilograms) or, alternatively, 56 pounds per square inch (4 kilograms per square centimeter) if the nip area is 1.25 square inches (8 square centimeters). The composite liquid ink image preferably adheres to the elastomer of the intermediate transfer member 14 when the photoreceptor 2 and the elastomer surface of the intermediate transfer member 14 are separated. The surface of photoreceptor 2 preferably releases the liquid ink image.

It is believed that the pressure contact between the intermediate transfer member 14 and photoreceptor 2 enhances the dwell time during which the composite image is in contact with both the intermediate transfer member 14 and the surface of the photoreceptor 2. It is preferred that the materials and diameters of the intermediate transfer member 14 and photoreceptor 2 and the force between them be selected such that the dwell time is at least 25 milliseconds and, preferably, approximately 52 milliseconds.

The elastomer of the intermediate transfer member 14 preferably has sufficient adhesive properties at temperature T1 to pick up the semi-dry liquid ink image from the surface of the photoreceptor 2. Further, the elastomer of the intermediate transfer member 14 preferably has sufficient release properties at temperature T2 to allow the film-formed liquid ink image to be released to the final image receptor 8. The elastomer of the intermediate transfer member 14 is also preferably able to conform to the irregularities in the surface of the final image receptor 8, e.g. the irregularities of rough paper. Conformability is accomplished by using an elastomer having a Shore A Durometer hardness of about 65 or less, preferably 50. In addition, the elastomer should preferably be resistant to swelling and attack by the carrier medium, e.g., hydrocarbon, for liquid inks. The elastomer of the intermediate transfer member 14 has an adhesive characteristic relative to liquid film forming inks that is greater than the adhesive characteristic of the liquid inks and release surface of photoreceptor 2 at temperature T1, but less than the adhesive characteristic of the liquid inks and the final image receptor 8 at temperature T2. The choice of the elastomer of the intermediate transfer member 14 is dependent on the release surface of photoreceptor 2, the composition of the liquid inks, final image receptor 8. For the process described here, several fluorosilicone elastomers meet these requirements, e.g., Dow Corning 94003 fluorosilicone dispersion coating, available from Dow Corning Corporation, Midland, Mich.

Subsequently, the composite liquid ink image adhered to intermediate transfer member 14 can be brought in pressure contact with the final image receptor 8, e.g. plain paper, at temperature T2 through a nip created with backup roller 10. Temperature T2 ranges from not nominally above room temperature to around 100 degrees Celsius. In one embodiment, the temperature T2 is not critical. Heating for this image transfer step is substantially provided by the already heated intermediate transfer member 14. No additional heat is believed necessary to facilitate transfer between the intermediate transfer member 14 and the final image receptor 8. However, it is also believed desirable that the backup roller 10 be heated to approximately 40 degrees Celsius to prevent the backup roller 10 from drawing a significant amount of heat from the intermediate transfer member 14. For this same reason, the final image receptor 8 may be preheated to around 35 degrees Celsius before transfer is attempted from the intermediate transfer member 14 to the final image receptor 8. If desired, however, T2 can be in the range of 70-150 degrees Celsius and, preferably is about 15 degrees Celsius. Under an applied force of preferably around one-half to two-thirds of the force between the intermediate transfer member 14 and the photoreceptor 2, preferably around 95 pounds per square inch (35 kilograms per square centimeter). The elastomer-coated intermediate transfer member 14 (preferably, a metal roller) bearing the composite toned image, is sufficiently compliant to conform to the topography of the final image receptor 8 so that every part of the composite liquid ink image, including small dots, can come into contact with the surface of the final image receptor 8 and transfer to the final image receptor 8.

The elastomeric transfer technique relies on a relative surface energy hierarchy among the surface of the photoreceptor 2, the intermediate transfer roller 14, the toner particles comprising the liquid inks and the final image receptor 8. Preferably, application of the transfer assist material to the photoreceptor surface should provide an imaging surface having an apparent surface energy less than the surface energy of the intermediate transfer roller 14. Further, the surface energy of the intermediate transfer roller 14 should be less than the respective surface energies of the liquid inks, and the surface energy of the final image receptor 8 should be greater than the surface energy of the intermediate transfer roller. If a contact drying means is used, the surface of the contact drying means is preferably capable of absorbing carrier liquid, but must have a surface energy less than that of the photoreceptor surface. This relative hierarchy of surface energies helps ensure a reliable and sequential transfer of the assembled multi-color image during elastomeric transfer In some embodiments, it is preferred that the surface energy of the photoreceptor 2 be at least 0.5 dyne per centimeter less than the surface energy of the intermediate transfer roller 14. Most preferred is that the surface energy of photoreceptor 2 be at least 1.0 dyne per centimeter less than the surface energy of the intermediate transfer roller 14. It is also preferred that the surface energy of the intermediate transfer roller 14 be at least 2.0 dyne per centimeter less than the surface energy of the liquid inks. Most preferred is that the surface energy of intermediate transfer roller 14 be at least 4.0 dyne per centimeter less than the surface energy of the liquid inks.

Surprisingly, in some embodiments, the application of a suitable low surface energy transfer assist material to a photoreceptor surface before development of the liquid toned image permits the use of a photoreceptor having a surface energy greater than that of the intermediate transfer roller in an elastomeric toner transfer process. This is advantageous in permitting the use of a wider variety of high surface energy photoreceptors, particularly photoreceptors not having surface release layers or inherent surface releasibility, in adhesive or elastomeric transfer imaging processes. The use of a transfer material to provide a renewable release surface release to the photoreceptor also increases the useful life of the photoreceptor without concern regarding the build-up of high surface energy residues which can degrade elastomeric transfer performance of the liquid tones images.

Any conventionally known photoreceptor may be employed with a suitable low surface energy transfer assist material according to the present invention. However, the photoreceptor surface preferably does not exhibit a surface release character prior to application of the transfer material. Most preferably, the adhesive strength of the photoreceptor surface is greater than 150 grams-force before application of the transfer material, as measured according to JIS Z 0237-1980, "Testing Methods of Pressure Sensitive Adhesive Tapes and Sheets," as described in U.S. Pat. No. 5,689,785 at column 5, lines 10-52, the disclosure of which is incorporated herein by reference.

In some embodiments of the present invention, the surface energy of the transfer material ranges from around 24 dyne per centimeter to around 26 dynes per centimeter, the surface energy of the intermediate transfer roller 14 ranges from around 26 dynes per centimeter to around 28 dynes per centimeter, the surface energy of the photoreceptor surface exceeds 26 dynes per centimeter, the surface energy of the developed liquid toned images ranges from around 30 dynes per centimeter to around 40 dynes per centimeter, and the surface energies for final image receptors 8 range from around 40 dynes per centimeter for plain paper to around 42 dynes per centimeter for overhead projection transparency film. All surface energies discussed herein are measured in dynes per centimeter at approximately room temperature, preferably at around 20° C. to 23° C.

The key to use of a high surface energy photoreceptor in an adhesive or elastomeric transfer imaging process lies in the ability of the transfer material to present a release surface to the liquid toned images subsequently developed on the photoreceptor. However, it would be unnecessarily wasteful to apply the low surface energy transfer material to the photoreceptor surface in areas where no liquid toner particles will be subsequently deposited to develop a toned image. Accordingly, in a preferred embodiment, the transfer material is applied to the photoreceptor surface by known liquid electrophotographic methods in an imagewise manner corresponding to the sum of the image data used to produce each subsequent toned image, as shown schematically in FIGS. 2*a*, 3*b*, 4*a*, 6*a* and 7*a*. Preferably, the transfer assist material comprises charged particles of low surface energy transfer material dispersed in a carrier liquid suitable for use in liquid electrophotographic toners as described above. Although any suitable carrier liquid may be used to disperse the charged particles of transfer material, preferably, the carrier liquid is selected to comprise the same chemical materials that are used as the carrier liquid for the subsequently developed liquid toners.

In FIG. 5*b*, a related electrophotographic system 5 using an intermediate transfer member 14 is shown. In this configuration, each of the development units 4*a*-4*e* has its own photoreceptor 2. Each photoreceptor 2 transfers its unique color ink film or transfer assist layer contribution to the complete image, which is compiled into a composite image on an intermediate transfer member 14. Because the drying unit 17 is preferably on the intermediate transfer member 14, rather than on multiple photoreceptors 2, it dries the whole image at once, rather than component parts, prior to transfer to the final image receptor 8. Therefore, the inks and, if necessary, the transfer assist layer must have formed a sufficient film on the photoreceptor 2 to be able to transfer to the intermediate transfer member 14. With these considerations in mind, the function of system 5 shown in FIG. 5*b* is substantially the same as that described for FIG. 5*a*.

Figure 6A:
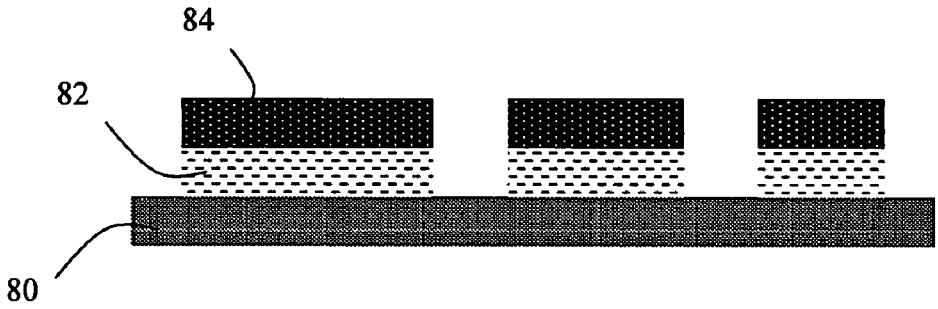
FIGS. 6*a*, 6*b* and 6*c* are side schematic views of an arrangement of toner and transfer assist layers in the steps involving toner transfer from a photoreceptor to an intermediate transfer member, then to a final receptor, wherein a transfer assist layer is applied to the photoreceptor before an ink/toner layer is applied.
Figure 6B:
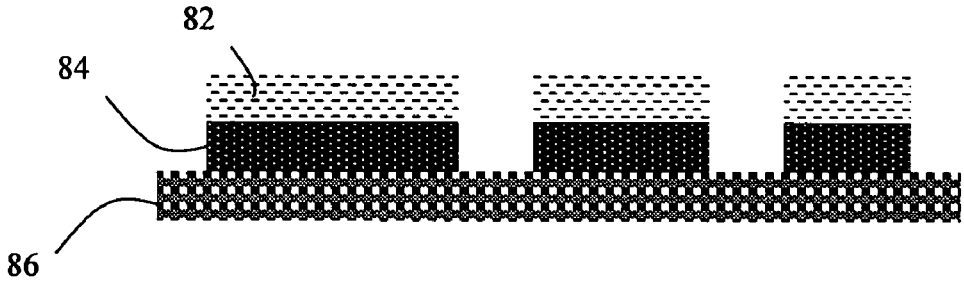
Figure 6C:
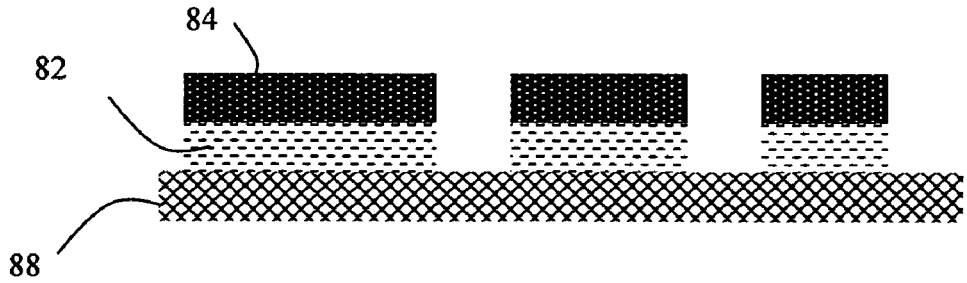

As discussed relative to FIG. 1, a transfer assist layer may be applied either before or after the application of a liquid toner on the photoreceptor. This placement is controlled by which development unit contains the transfer assist layer. In another embodiment of the present invention, FIG. 6*a* shows a first step of an electrophotographic process using equipment similar to that shown in FIG. 5*a*. In FIG. 6*a*, a transfer assist layer 82 is first applied to a photoreceptor 80, then a film-forming toner layer 84 is applied on top of the transfer assist layer 82. When the toner accumulation is complete, the image may then be transferred to an intermediate transfer member 86, as shown schematically in FIG. 6*b*. In this step, the toner film 84 is transferred to the intermediate transfer member 86, and the transfer assist layer 82 is then "on top" of the layers. A final step of this process is illustrated in FIG. 6*c*, in which the image is transferred to the final receptor or substrate 88. This results in the transfer assist layer 82 being positioned between the final receptor 88 and the toner film 84, with the toner layer 84 "on top."

In this embodiment of the process (i.e., using an intermediate transfer member), the transfer assist layer can function either as a release layer as described for FIGS. 2*a* and 2*b*, or as a "sacrificial layer" that can split as described for FIG. 3*b*. Even though the photoreceptor of this invention preferably has a release coating (such as the one disclosed in U.S. Pat. No. 5,650,253), the use of a consumable transfer assist layer can prolong the life of the release layer, or prolong the life of the photoreceptor if the release layer is damaged, enhance the functionality of the photoreceptor release layer, or provide a consumable substitute for a permanent photoreceptor release layer. These functions of the transfer assist layer are primarily determined by the position of this layer relative to the photoreceptor and toner layers. In one aspect, the transfer assist layer shown as layer 82 in FIGS. 6*a* through 6*c* may be partially left on the photoreceptor 80 (not shown) in the transfer to the intermediate transfer member 86. In this embodiment, the transfer assist layer 84 in FIG. 6*b* may be less thick than the initial transfer assist layer 84 of FIG. 6*a*. The transfer assist layer 82 can also function as described relative to FIG. 4, improving transfer by chemical and physical bonding with the toner film 84 and encouraging adhesion to the final receptor 88. Additionally, all of the additional benefits and properties discussed above that are unrelated to the actual transfer performance and that may be included in the transfer assist layer (including abrasion and UV protection and adhesion promotion) may also be included within the scope of this embodiment.

In the embodiment of the present invention shown in FIG. 5*b*, the layers shown in FIG. 6*a* could include only the toner layer 84 on the photoreceptor 80 (i.e., the transfer assist layer 82 would not be applied in this step). Instead, the transfer assist layer 82 could be initially applied over at least a portion of the toner layer 84 after it has been transferred to the intermediate transfer member 86 in FIG. 6*b*. FIG. 5*b* shows a larger intermediate transfer member 14 that provides enough space for a development unit or applicator to meter the transfer assist layer 82 on top of the final toned image on the intermediate transfer member. The transfer assist layer could also be added by means of a metering or application roller, dispenser, brush, or spray.

Figure 7A:
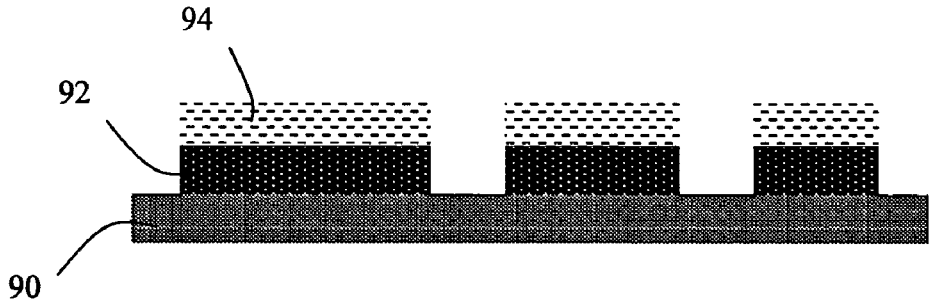
FIGS. 7*a*, 7*b* and 7*c* are side schematic views of an arrangement of toner and transfer assist layers in the steps involving toner transfer from a photoreceptor to an intermediate transfer member, then to a final receptor, wherein a transfer assist layer is applied to the photoreceptor after an ink/toner layer is applied.
Figure 7B:
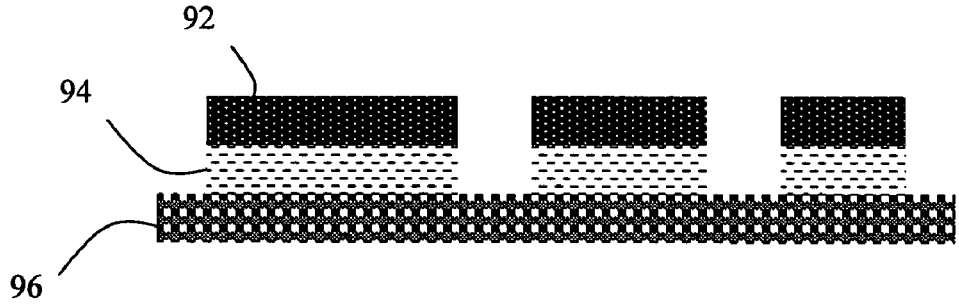
Figure 7C:
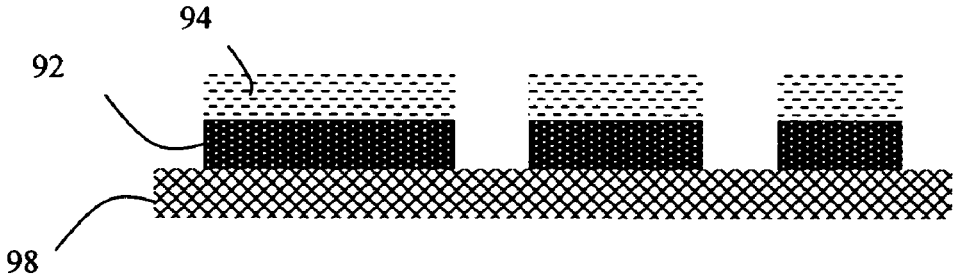

FIGS. 7*a*-7*c* illustrate the transfer steps and layer arrangement for a process using an intermediate transfer member, where the transfer assist layer is placed on the photoreceptor after the toned image is completely formed. As shown in FIG. 7*a*, a toner layer 92 is applied to or positioned on a photoreceptor 90, with a transfer assist layer 94 applied over the top of the toned image film 92. In the next step of the process, shown in FIG. 7*b*, the image is transferred to the intermediate transfer member 96, leaving the transfer assist layer 94 in contact with the intermediate transfer member 96 and the toner film 92 exposed. A final step in this process is shown in FIG. 7*c*, in which the image is transferred to a final receptor 98, so that the toner layer 92 is in contact with the receptor 98 and the transfer assist layer 94 is exposed.

This embodiment advantageously utilizes the ability of the transfer assist layer 94 to act as a release or sacrificial layer from the intermediate transfer member 96, where such advantages of this layer are similar to those described above relative to FIGS. 2 and 3.

It is also possible to delay the application of the transfer assist layer 94 over the toner layer 92 on the photoreceptor 90 (as in FIG. 7*a*), and to instead apply the transfer assist layer 94 with a metering roller (not shown) directly to the intermediate transfer, member 96 before the toned image is transferred thereon. This is embodied in the apparatus of FIG. 5*b* where the transfer assist material cartridge is in position 4*e* and is in contact with the intermediate transfer member prior to image transfer from the other development units to the final receptor. Additionally, this embodiment takes advantage of the transfer assist layer 94 on the surface of the image 92 on the final receptor 98 to promote such features as ultraviolet protection and abrasion resistance, for example. In this embodiment, development unit 4*e*, for example, could be placed downstream of the drying unit (17 in FIGS. 5*a* and 5*b*) if a less dry transfer assist layer is desired.

These embodiments above describe basic arrangements of using a transfer assist layer in a tandem electrophotographic process that uses adhesive transfer. In accordance with the present invention, the transfer assist layer can be applied between any toner layers, if desired. Further, it is possible for multiple transfer assist layers to be applied in a particular electrophotographic process, such as may be done so that various transfer assist layers may provide different advantageous properties to the image and processes.

Figure 8:
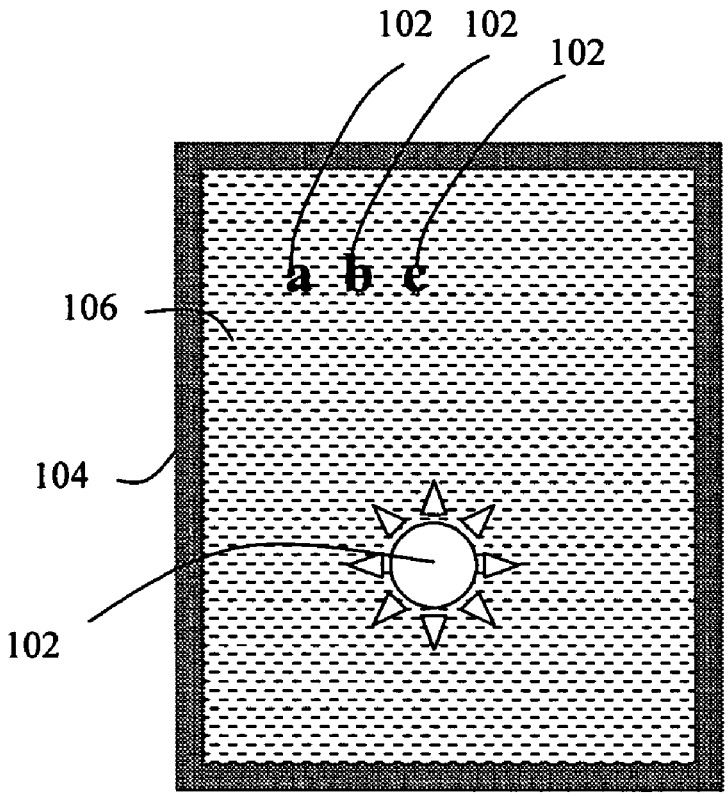
FIG. 8 is a top view of one example of an image plated onto a photoreceptor, wherein a transfer assist layer is applied initially to the entire imaging area.

The various figures for this invention illustrate a transfer assist layer that covers the same approximate area as the toner film area or toner layers ("imagewise transfer"). This is for representative purposes only, where actual applications may include toner layers and transfer assist layers of various thicknesses and coverage areas, even within a single imaging process. For example, FIG. 8 illustrates a photoreceptor 104 plated or generally covered with a transfer assist layer 106 that will contact the final receptor (not shown). This transfer assist layer may be applied as a "flood coating", for example, where the entire drum or photoreceptor is coated with the transfer assist material before the application of any toner images. In FIG. 5*b*, it is contemplated that the intermediate transfer member be "flood coated". This might be particularly useful if the transfer assist layer 106 is to end up on the surface of the printed image, such as to serve as a protective coating. The toner may then be applied on top of the transfer assist layer 106 in toner image areas 102, and then both the image areas 102 and transfer assist layer 106 may be transferred to a final image receptor.

Figure 9A:
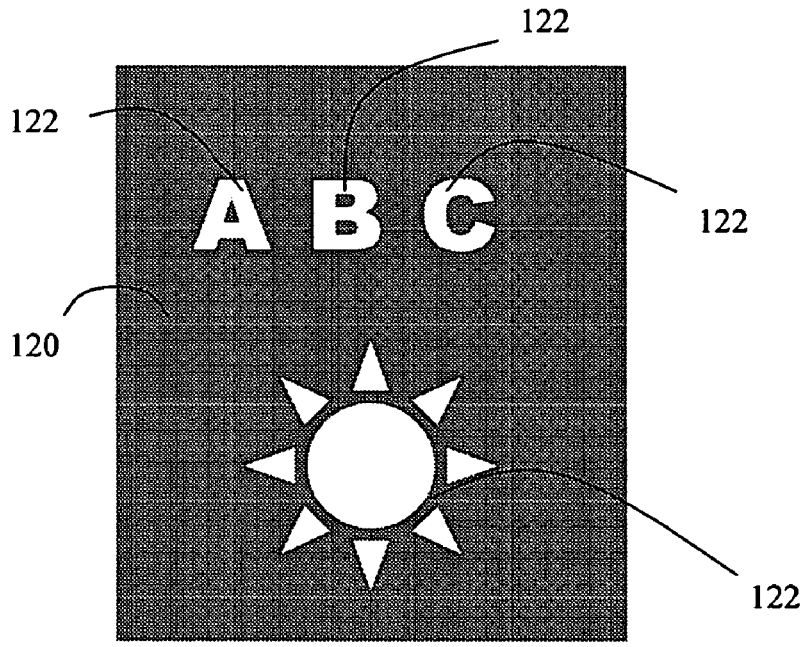
FIGS. 9*a* and 9*b* are top views of an image plated onto a photoreceptor, illustrating how the transfer assist layer is applied to only those areas that receive pigmented liquid toner.
Figure 9B:
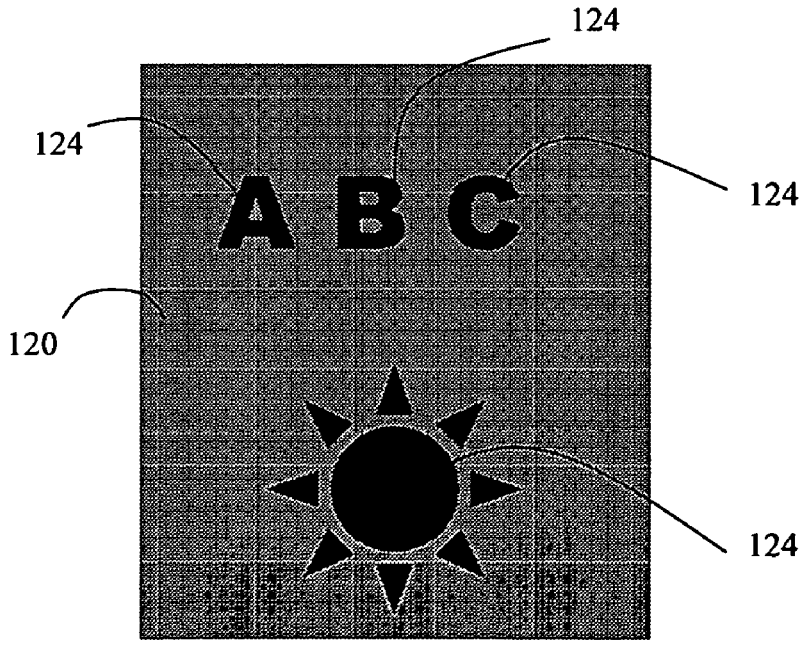

In the apparatus of FIG. 5*b*, the intermediate transfer member could receive the image first as a layer of transfer assist material, then the other photoreceptors could transfer their colors, or vice versa. In a preferred embodiment, as seen in FIG. 9*a*, the transfer assist material may be only applied to a photoreceptor 120 in image areas 122 where an image will be applied, such that the areas surrounding these image areas 122 will be void of any applied transfer assist material. Toner images 124 may then be applied to these image areas 122, as shown in FIG. 9*b*. This type of system might be most desired where the primary purpose of the transfer assist layer or material is to provide a release from the photoreceptor or the intermediate transfer member.

The present invention has now been described with reference to several embodiments thereof. The entire disclosure of any patent or patent application identified herein is hereby incorporated by reference. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the structures described herein, but only by the structures described by the language of the claims and the equivalents of those structures.

The invention claimed is:

1. A method of producing a composite image on a final image receptor from image data in a single pass electrophotographic system, comprising the steps of:

providing a photoreceptive element;

providing a transfer assist material development unit containing a liquid transfer assist material comprising transfer assist material particles dispersed in a first carrier liquid;

applying the transfer assist material to at least a portion of the surface of the photoreceptive element;

presenting the photoreceptive element to at least one toner development unit comprising a toner, wherein the following steps (a) through (c) are performed in a single pass of the photoreceptive element;

(a) applying a substantially uniform first electrostatic potential to the photoreceptive element;

(b) selectively discharging the photoreceptive element in an imagewise manner to create a first latent image having a second electrostatic potential that is less than the absolute value of the first electrostatic potential; and (c) exposing the photoreceptive element to the toner comprising charged toner particles dispersed in a second carrier liquid, wherein the charged toner particles selectively deposit on the discharged portions of the surface of the photoreceptive element to develop the first latent image and create a toned image overlapping at least a portion of the transfer assist material on the surface of the photoreceptive element;

wherein the transfer assist material and the toned image form a composite image layer on the photoreceptive element that is formed in the single pass of the photoreceptive element;

substantially drying the composite image layer to remove at least a major portion of the second carrier liquid during the single pass of the photoreceptive element; and contacting the composite image layer with a first side of a final image receptor having two sides and applying force to the second side of the final image receptor with a backup element, causing the composite image layer to adhesively transfer to the first side of the final image receptor.

2. The method of claim 1, further comprising the step of contacting the composite image layer with a drying element while the composite image layer is still on the photoreceptive element.

3. The method of claim 2, wherein the drying element is heated.

4. The method of claim 2, wherein the drying element comprises a carrier liquid absorbent coating.

5. The method of claim 2, wherein the drying element is rotatable.

6. The method of claim 5, wherein the drying element is a belt.

7. The method of claim 1, wherein the substantially dried composite image layer comprises greater than 75% solids by weight.

8. The method of claim 1, wherein the force provided by the backup element to transfer the composite image layer from photoreceptive element to the final image receptor is in the range of about 60 pounds to about 70 pounds of force.

9. The method of claim 1, wherein the backup element is heated to at least 800° C.

10. The method of claim 1, wherein the backup element is heated to about 105° C.

11. The method of claim 1, further comprising performing the following steps (d) through (f) at least once in the single pass of the photoreceptive element after the steps (a) through (c) are performed:

(d) applying a substantially uniform third electrostatic potential to the photoreceptive element;

(e) selectively discharging the photoreceptive element in an imagewise manner to create a second latent image having a fourth electrostatic potential that is less than the absolute value of the third electrostatic potential; and (f) exposing the photoreceptive element to the toner comprising charged toner particles dispersed in a second carrier liquid, wherein the charged toner particles selectively deposit on the discharged portions of the photoreceptive element to develop the second latent image, wherein the toned image comprises the developed first and second latent images.

12. The method of claim 1, wherein the photoreceptive element is rotatable.

13. The method of claim 12, wherein the photoreceptive element is a photoreceptive drum.

14. The method of claim 1, wherein the surface of the photoreceptive element has an adhesive strength measured according to JIS Z 0237-1980 "Testing Methods of Pressure Sensitive Adhesive Tapes and Sheets" greater than 150 grams-force before the step of applying the transfer material.

15. The method of claim 1, wherein the toner particles have a glass transition temperature of less than about 35° C.

16. The method of claim 1, wherein the transfer assist material is a non-pigmented liquid toner comprising charged particles derived from a surface release promoting moiety dispersed in a carrier liquid.

17. The method of claim 16, wherein the method of applying the transfer assist material to the photoreceptive element is electrophoretic development of the charged particles of transfer assist material in an imagewise manner corresponding to the sum of the image data used to produce each toned image.

18. The method of claim 1, wherein the particles of the transfer assist material have a volume mean particle size greater than 1 micron.

19. The method of claim 1, wherein the particles of the transfer assist material have surface release characteristics.

20. The method of claim 1, wherein the transfer assist material comprises an additive to enhance durability of the image layer on the final image receptor.

21. The method of claim 1, wherein the particles of the transfer assist material have a glass transition temperature between about −1° C. and 35° C.

22. The method of claim 1, wherein the final image receptor is paper.

23. The method of claim 1, wherein the first and second carrier liquids comprise the same chemical material.

24. The method of claim 1, wherein the step of selectively discharging portions of the photoreceptive element comprises selectively exposing portions of the surface of the photoreceptive element to actinic radiation selected from the group consisting of ultraviolet radiation, visible light, and infrared radiation.

25. The method of claim 1, wherein the transfer assist material comprises an organosol having a glass transition temperature that is higher than the glass transition temperature of the liquid ink that comprises the toned image.

26. The method of claim 1, wherein the substantially dried composite image layer on the photoreceptive element forms a cohesive film.

27. The method of claim 1, wherein prior to the step of contacting the composite image layer with a first side of a final image receptor, the method further comprises the step of contacting the composite image layer with a heated intermediate transfer member that provides a sufficient amount of heat and pressure to cause at least a portion of the substantially dried composite layer to elastomerically transfer to the intermediate transfer member.

* * * * *

UNITED STATES PATENT AND TRADEMARK OFFICE

CERTIFICATE OF CORRECTION

PATENT NO. : 7,294,441 B2
APPLICATION NO. : 10/884702
DATED : November 13, 2007
INVENTOR(S) : James A. Baker et al.

It is certified that error appears in the above-identified patent and that said Letters Patent is hereby corrected as shown below:

Column 24,
Claim 9, Line 39, delete "at least 800°C." and insert in place thereof --at least 80°C.--.

Signed and Sealed this

First Day of April, 2008

JON W. DUDAS
*Director of the United States Patent and Trademark Office*